US012085351B2

(12) United States Patent
Reis Green

(10) Patent No.: US 12,085,351 B2
(45) Date of Patent: Sep. 10, 2024

(54) MUZZLE ACCESSORY MOUNTING SYSTEM

(71) Applicant: Austin Reis Green, Watertown, WI (US)

(72) Inventor: Austin Reis Green, Watertown, WI (US)

( * ) Notice: Subject to any disclaimer, the term of this patent is extended or adjusted under 35 U.S.C. 154(b) by 85 days.

(21) Appl. No.: 17/936,644

(22) Filed: Sep. 29, 2022

(65) Prior Publication Data

US 2023/0228516 A1 Jul. 20, 2023

Related U.S. Application Data

(60) Provisional application No. 63/300,479, filed on Jan. 18, 2022.

(51) Int. Cl.
*F41A 21/32* (2006.01)

(52) U.S. Cl.
CPC ..... *F41A 21/325* (2013.01)

(58) Field of Classification Search
CPC ..... F41A 21/26; F41A 21/28; F41A 21/30; F41A 21/32; F41A 21/325; F41A 21/34; F41A 21/36; F41A 21/38
USPC ..... 89/14.05, 14.2, 14.3, 14.4, 14.5
See application file for complete search history.

(56) References Cited

U.S. PATENT DOCUMENTS

| | | | | |
|---|---|---|---|---|
| 1,021,742 | A | 3/1912 | Moore | |
| 1,054,434 | A | 2/1913 | Maxim | |
| 2,448,593 | A | 9/1948 | Heising | |
| 3,710,679 | A | 1/1973 | Werbell | |
| 4,510,843 | A | 4/1985 | Rabatin | |
| 5,433,133 | A | 7/1995 | La France | |
| 5,559,302 | A | 9/1996 | Latka | |
| 7,661,349 | B1 | 2/2010 | Brittingham | |
| 7,676,976 | B2 | 3/2010 | Dueck et al. | |
| 7,743,693 | B1 | 6/2010 | Brittingham | |
| 8,091,462 | B2 | 1/2012 | Dueck et al. | |
| 8,459,406 | B1 | 6/2013 | Dueck | |
| 8,505,680 | B2 | 8/2013 | Dueck | |
| 9,464,857 | B2 | 10/2016 | Lessard | |
| 9,739,560 | B1 * | 8/2017 | Salvador | F41A 21/34 |
| 9,791,234 | B2 * | 10/2017 | Palu | F41A 21/325 |
| 9,921,021 | B1 | 3/2018 | Graham, II | |
| 10,480,883 | B2 * | 11/2019 | Smith | F41A 21/30 |
| 10,480,888 | B2 * | 11/2019 | Barrett | F41A 21/28 |
| 10,883,787 | B2 * | 1/2021 | Palu | F41A 21/30 |
| 11,054,208 | B2 * | 7/2021 | Johansen | F41A 21/325 |
| 2010/0229712 | A1 | 9/2010 | Graham | |
| 2012/0180623 | A1 * | 7/2012 | Graham, II | F41A 21/325 89/14.4 |
| 2018/0299223 | A1 * | 10/2018 | Barrett | F41A 21/30 |
| 2019/0353446 | A1 | 11/2019 | Kras | |

(Continued)

*Primary Examiner* — John Cooper
(74) *Attorney, Agent, or Firm* — Dunlap Bennett & Ludwig, PLLC

(57) ABSTRACT

A locking firearm silencer mount or firearm muzzle accessory mount improvement system and method. The coupling device provides an internal thread and sealing taper, as well as an actively sprung locking collar with one or more locking positions. The muzzle device provides a thread and sealing taper operatively associated to the mount socket. The threads on the mount and muzzle accessory effectuate mating between the locking mount and the firearm muzzle accessory in a single axial orientation.

20 Claims, 3 Drawing Sheets

(56) References Cited

U.S. PATENT DOCUMENTS

2021/0199401 A1* 7/2021 Magee ..... F41A 21/30
2022/0325972 A1* 10/2022 Lovas ..... F41A 21/325

* cited by examiner

MUZZLE ACCESSORY MOUNTING SYSTEM

CROSS-REFERENCE TO RELATED APPLICATION

This application claims the benefit of priority of U.S. provisional application No. 63/300,479, filed Jan. 18, 2022, the contents of which are herein incorporated by reference.

BACKGROUND OF THE INVENTION

The present invention relates to firearm silencer mounts, and, more particularly, a firearm muzzle accessory mount locking mechanism and mating firearm muzzle adapter that prevents the firearm silencer from coming loose or misaligned during use of the firearm.

Firearm silencers, blank firing adapters, and blast shields are subjected to heat and vibration during the firing of firearms. Silencers are typically thread attached to the threaded ends of barrels, often without the use of tools. Silencers are also commonly attached to muzzle devices which are installed with the assistance of tools, to the threaded muzzle end of firearm barrels. Heat and vibration work to loosen firearm silencers. Inadvertent loosening and concomitant misalignment will cause dangerous and often catastrophic damage to the silencer as bullets strike the baffles.

It is desirable for firearm silencers to have convenient and quick, tool-less mounts which mitigate the risk of loosening, while facilitating substantially precise coaxial alignment between the bore of the silencer and the bore of the barrel of the firearm. Military or law enforcement organizations as well as many consumers often desire loss prevention mechanisms to accompany duty-use or personally owned firearm silencers. These locking mechanisms reduce agency, department, unit, or personal liability for the loss of somewhat heavily regulated silencers. It is desired for such locking systems to provide security without negatively impacting the core system goals of consistent alignment and rigid mounting.

Currently many silencers have mounting mechanisms designed to, in some way, address this problem. These mounts are commonly referred to with terms like fast attach, quick attach, or quick disconnect mounts. The companies making the mounts generally market the mounts as if they guarantee retention, although very few of these mounts have true locking mechanisms. Many of the systems only have ratcheting, clicking teeth, or friction mechanisms. Often these mechanisms are far too coarse in their arrestment, to retain the silencer in an ideal, rigid, and properly mounted configuration for accurate, consistent use. Sometimes the existing systems have buttons or latches that can be inadvertently pressed or deactivated, allowing silencers to loosen enough to promote point of impact shift, or even to be totally disconnected and lost during actions such as helicopter airborne sharp-shooting, mountain climbing, or the like. Often the mount mechanisms fail to rigidly mount the silencers, and many systems add prohibitive amounts of system weight to firearm muzzle devices. Sometimes the parts of the mounts are small or numerous, and/or fragile. Often system parts click or drag against one another and wear out, eventually leading to system failure. Silencer mounts are also demanded and used for other purposes such as blue Simunition or UTM training suppressors, blank firing adapters, and blast shields devices that project muzzle blast forward to mitigate some operator hearing exposure. The investment in a silencer mounting system is especially significant for customers with a need to purchase and issue multiple category products. This makes the quality of an attachment system even more important.

There is an obvious need for true, locking mounts that allow silencers to be rapidly and repeatedly attached in a consistent and ideal alignment condition for accurate shooting.

SUMMARY OF THE INVENTION

In one aspect of the present invention, a mounting system for a muzzle accessory of a firearm, the system includes: a muzzle mating device having a plurality of grooves radially spaced apart along an outer circumference thereof; and a locking mount includes a socket for bayonetting the muzzle mating device; a collar operatively associated with an outer circumference of locking mount in such a way as to be movable between a locked position and an unlocked position; and one or more locking splines extending radially inward from a rearward portion of the collar to protrude into the socket, where wherein the unlocked position the locking spines are linearly offset from the plurality of grooves in an unlocked configuration.

In another aspect of the present invention, mounting system further includes: a first thread along an outer circumference of the muzzle mating device; and a socket wall defining the socket, wherein a second thread is disposed along an inner circumference of the socket wall, wherein said threads are operatively associated in a locked configuration; further including a locking pin extending radially inward from an inner surface of the collar; and one or more slots provided in the socket wall, wherein for each locking pin each slot provides a locked position point and wherein the one or more slots provides an unlocked position point, wherein the locking pin is ridable along each slot between each locked position point and the unlocked position point, wherein the locked position point restrains rearward linear movement and rotational movement of the locking pin, and wherein the unlocked position point restrains rearward linear movement of the locking pin, wherein the locked position point is rearward of the unlocked position point, wherein the collar is biased in a rearward direction; further including a sinusoidal spring to bias the collar in the rearward direction; further including: a first alignment taper disposed along a forward portion of the muzzle mating device; and a second alignment taper disposed along a forward portion of the socket wall, wherein said alignment tapers mechanically communicate in the locked and/or mated configuration; and further including: an internal thread provided by the muzzle mating device, wherein the internal thread directly connects to the firearm, wherein the one or more locking slots are two locking slots set out of phase relative one-half of a groove phase of the plurality of grooves, wherein a tolerance zone is enabled for the locked configuration.

In yet another aspect of the present invention, a mounting system for a muzzle accessory of a firearm includes a muzzle mating device having a first linear restraint and a first annular rotational restraint rearward of the first linear restraint; and a locking mount having a second linear restraint and a second rotational restraint, wherein the second rotational restraint is linearly movable relative to the second linear restraint between an unlocked position and a locked position operatively associating said rotational restraints, and wherein the unlocked position linearly disassociates said rotational restraints, wherein the linear disassociation is in a direction normal to the plane of the first annular rotational restraint.

In yet another aspect of the present invention, a mounting system for a muzzle accessory of a firearm includes a first portion having a first rotational restraint; and a second portion having a collar with a second rotational restraint, wherein a linear movement of the collar relative to both the first and second portions operative associates of the first and second rotational restraints, whereby relative rotational movement between the first and second portions is restrained, wherein the first portion provides a first linear restraint, wherein the second portion provides a second linear restraint that are operatively associated prior to the operative association of said rotational restraints.

Further embodiments of the present invention includes firearm silencer mount or firearm muzzle accessory mount having a front portion having silencer mount or firearm muzzle accessory mount including the following: a cylindrical body, or quasi cylindrical body extending between a rear portion and a forward portion; a portion of the rear of the body comprising a reduced outside diameter, or portion rear of a groove and retaining ring, or other proud feature capable of buttressing a spring, wherein a portion of the rear of the body includes a slot, wherein a spring, and a collar comprising a plurality of inside diameter splines are operatively associated coaxially to the body, wherein a screw or pin operatively associates the collar to a slot, which has at least a locking position, and an unlocked position to secure the collar in a spring depressed, configuration for receiving a barrel end muzzle device, wherein the mount further includes a through bore circumscribed by the body, wherein the through bore has a sealing alignment taper, and an inside diameter thread capable of receiving an externally threaded firearm barrel end muzzle device or coupler, wherein the splined collar is capable of operatively associating to a pattern of longitudinal grooves on an external surface of the receiving firearm barrel end muzzle device or coupler, to arrest the rotary motion of the splined collar and mount relative to the central bore axis.

Another embodiment of the present invention includes firearm silencer mount or firearm muzzle accessory mount having the following: wherein the mount is natively manufactured or welded into the rear of a silencer tube or silencer body, wherein the pin or screw is represented by a plurality of pins or screws, wherein the slot is represented by a plurality of slots, wherein each slot defines a unlocking position, and a plurality of locking positions, wherein the plurality of locking positions are axially displaced from one another such that the minimum axial degrees of locking arrestment of the muzzle mating device is effectively decreased with the addition of each additional, axially displaced, locking position, wherein the interfacing muzzle accessory is a silencer, and the mount is capable of being operably attached to the receiving end of a silencer tube, wherein the interfacing muzzle accessory is a muzzle blast redirector, and the mount is capable of being operably attached to the receiving end of a silencer tube.

Yet another embodiment of the present invention includes firearm silencer mount or firearm muzzle accessory mount having: a cylindrical body, or quasi cylindrical body extending between a rear portion and a forward portion; a portion of the rear of the body having a reduced outside diameter 33, wherein a spring, and a locking collar are coaxially fitted in a sliding bore over shaft fit, over the reduced, rear diameter of the body, wherein the collar is spring biased in a rearward direction, wherein the mount further comprises a through bore circumscribed by the body, wherein the through bore has a shoulder or taper, and an inside diameter thread capable of receiving an externally threaded firearm barrel end muzzle device or coupler. By reduced outside diameter 33 of the body, as indicated in FIG. 1, it is understood to refer to the surface the spring is operably associated coaxially to in a sliding fit, as this surface has to be reduced because the spring requires a larger diameter to push off of, or the spring will just exist there and do nothing for the assembly. This shoulder could be a snap ring, or it could be an increased diameter on the part.

It being understood that linear means along the longitudinal axis of the barrel of the firearm, normal to a cross-section of any bore a projectile of the firearm travels through during operation.

The present invention contemplates a mounting system, wherein the one or more locking slots are two locking slots set out of phase relative half of a groove axial phase of the plurality of grooves, wherein a half groove tolerance zone is enabled for the locked configuration. The idea being that the mounting system provides half the distance from one axial groove to another out of phase of each other, such that the system can use the two positions to make the device act as though it has twice as many grooves, while still maintaining robust grooves, as compared to very fine fragile grooves to accomplish the same end goal.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring now to FIGS. 1 through 7, the present invention includes a firearm muzzle accessory coupling device and system, and a method of using the same to enable repeatable and rigid alignment of a muzzle accessory relative to the barrel of the firearm.

Figure 1:
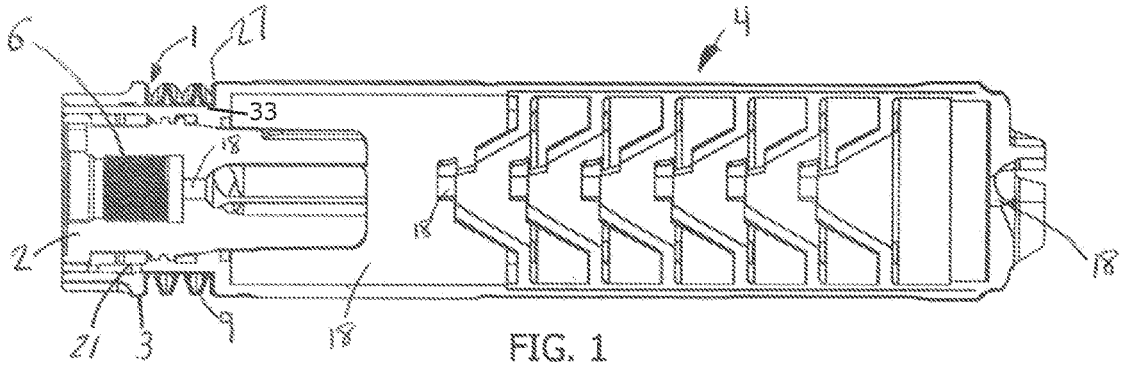
FIG. 1 is a side section view of an exemplary embodiment of a firearm locking mount 1 of the present invention natively manufactured into the tube of the silencer, and mechanically communicating with a muzzle mating device 2.
Figure 2:
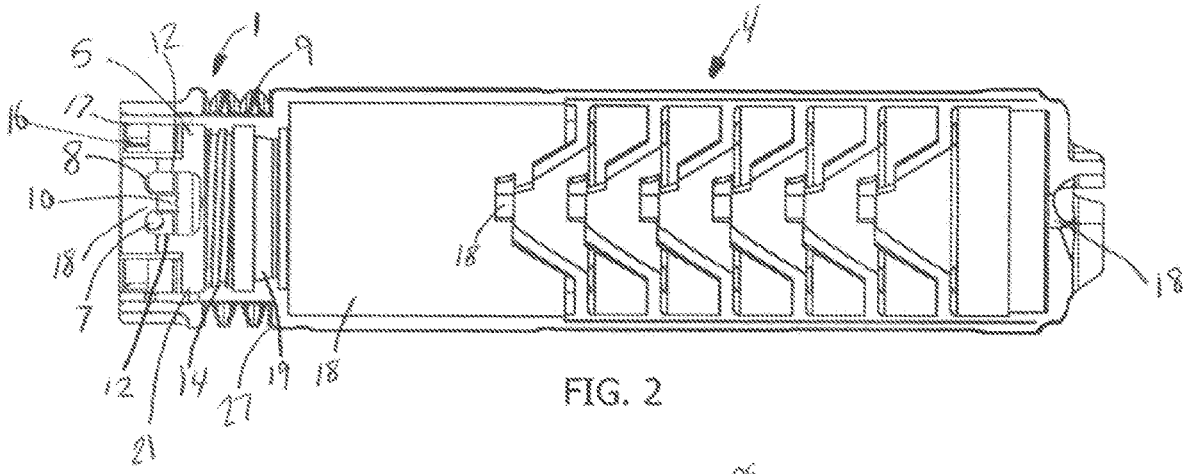
FIG. 2 is a side section view of an exemplary embodiment of the firearm locking mount 1 of FIG. 1 without the muzzle mating device 2.

Referring to FIG. 1 for definitional establishment, as used herein, the word "forward", "front", or "discharge end" corresponds with the firing exit direction of the firearm—i.e., the projectile travels through a firearm barrel threaded into the "rear", or "receiving end" of the muzzle mating device 2 of FIGS. 1, 5, 6, & 7, and said projectile travels successively through the bores in the muzzle mating device 2 and the operatively associated muzzle accessory. In the event of the muzzle accessory is a sound suppressor, the bullet travels through bores in the tube, baffles, and front cap, respectively, prior to exiting the sound suppressor discharge end, and continuing its flight to a target.

The outside diameter is defined as the outer circumference of parts coaxially surrounding the inside diameter defined by the bore permitting the passage of the projectile fired from the barrel of an attached firearm (not shown) when the parts representing an embodiment of the invention are in assembly, such as seen in FIG. 1, and attached to a firearm's threaded barrel, via the muzzle mating device 2 shown in FIG. 1.

As shown in FIGS. 1 through 7, the present invention pertains to a novel firearm locking mount 1 capable of mechanical communication with a muzzle mating device 2. In one embodiment, the firearm locking mount 1 may be natively manufactured into a sound suppressor 4. In other embodiments, the firearm locking mount 1 may be a separate piece of hardware (i.e., a modular component in a muzzle accessory mounting system). The firearm locking mount 1, muzzle mating device 2, and sound suppressor 4, each have through bores 18, which in assembly are generally coaxial with the bore of the barrel that the muzzle mating device 2 is attached to, thereby permitting the passage of a projectile fired from the mated barrel of the firearm.

The muzzle mating device 2 features an internal thread portion 6 allowing it to be mated to the threaded end of a firearm barrel (not shown). The muzzle mating device 2 has an external thread portion 11, allowing it to be operatively associated to internal thread portion 14 of the firearm locking mount 1.

The firearm locking mount 1 provides a socket wall 5 that defines a socket 17 within which the muzzle mating device 2 may be slidably received. The circumferential surface of the socket wall 5 operatively associates with a coaxial locking collar 3. The locking collar 3 is generally linearly and rotatably movable relative to the socket wall 5. Though the locking collar 3 provides one or more locking pins 7 protruding radially inward. Each pin 7 may operatively associate with a corresponding slot, plurality of slots or slot track 8 formed into the socket wall 5, thereby controlling and limiting the movement of the locking collar 3 relative to the socket wall 5 during certain conditions. A protrusion or other fastener could be used for the purpose of the locking pins 7.

The locking collar 3 provides radially spaced apart splines 16 along its rearward edge. The splines 16 extend radially inward, beyond the socket wall 5 and protrude into the profile of the corresponding socket of the socket wall 5.

A spring 9 biases the locking collar 3 rearward. The spring 9 shown in FIGS. 1-4 is a sinusoidal wave spring of a high temperature spring material, but a conventional spring could also be used. The preferred spring tempered materials for springs are in order of preference, Inconel 718, A286, and 17-7. The sinusoidal wave spring has the advantage of short implementation length, and great surface area exposed to the atmosphere, for air cooling to protect the spring from high silencer temperatures.

The slot 8, plurality of slots 8 or slot track provides at least one rearward locked position 12, and at least one forward unlocked position 10. The locked position 12 provides a rearward stop and bilateral stops, preventing rearward linear movement and rotational movement of the collar 3, respectively, though allowing forward movement against the force of the spring 9. The unlocked position 10 provides a rear linear stop resisting the force of spring 9, preventing linear movement urged by the spring 9, or "hanging" the pin 7. The unlocked position 10 provides at least one lateral space, enable the locking collar 3 to rotationally move its associated pin 7 to one or more locked positions 12.

Moving to the unlocked position 10, the splines 16 are linearly moved forward relative to the static socket wall 5. In the unlocked position, the splines 16 of the collar 3, are out of reach of a plurality of grooves 15 disposed along outer circumference of a rearward portion of the operatively associated muzzle mating device 2. Thus, the muzzle accessory mounting system embodied by the present invention provides movability between an unlocked configuration and a locked configuration. The unlocked configuration is where the locking pin(s) 7 is/are disposed in the unlocked position 10, whereby the splines 16 cannot engage the plurality of grooves 15. The locked configuration is when the locking pin(s) 7 is/are disposed in the locked position 12 and wherein the splines 16 engage the plurality of grooves 15.

The grooves 15 are cut in a circumferential surface of the muzzle mating device 2 is configured to be received in a slide-in engagement with the complementary socket 17 defined by the socket wall 5. The socket 17 helps to guide the muzzle mating device 2 in a substantial coaxial manner into the socket 17 for aligned engagement between the sealing taper 19 of the firearm locking mount 1 with the corresponding sealing alignment taper 20 of the muzzle mating device 2. An alignment feature 21, which, in part, locally reduces the diameter of the bore, forward of the larger socket 17. This alignment feature 21 provides close coaxiality of the thread 11 on the muzzle mating device 2, assisting in speed of thread engagement. In other words, the alignment feature 21 is structure that reduces diameter so that the thread is a closer fit, and hence more coaxiality is achieved, allowing the threads to spin together more readily with less "searching". The alignment feature is sometimes called the Rapid index (RI) as, it speeds the mounting in approximately half.

With the collar 3 in the unlocked position, the muzzle mating device 2 can be bayonet inserted into the socket 17. At this point the thread 11 is coaxial within bore 18, and the grooves 15 are coaxial within the socket 17, guiding the muzzle mating device 2 into rotational thread engagement between threads 11 and 14. Tightening the firearm locking mount 1 into sealing alignment between tapers 19 and 20, the collar 3 can then be further depressed against spring 9, and rotated to allow guiding pin or pins 7 to align with the slot 8 whose endpoint is the locked position 12. Moving to the locked position 12 allows the spring 9 to actively lock the collar 3 by urging it rearward so that the splines 16 of the collar 3 slidably engage the plurality of grooves 15 of the muzzle mating device 2. At this point the firearm locking mount 1 is locked in rigid, sealed, and aligned assembly with the firearm barrel by way of the muzzle mating device 2.

The threads 11 and 14 may be several different industry patterns such as but not limited to UNF, UNEF, or STUB ACME, and may have a helix of 0.125"-0.05" per rotation, or 8-20TPI. Coarse threads are preferable for the greatest durability during rough handling of the firearm. Altering the helix angle slightly within the range of 8-20TPI may be desirable to adjust the mounting and prevailing torque characteristics of the firearm locking mount 1 as well as the fineness of arrestment of the locking collar 3.

The muzzle mating device 2 may include a tool receiving feature or plurality of tool-receiving features such as the wrench flats 22 and slots 23 facilitating secure installation and uninstallation of the muzzle mating device 2 to the firearm. Slots 23 allows the muzzle mating device 2 to be unscrewed from the firearm locking mount 1 in the event the muzzle mating device 2 is unscrewed from the barrel without being removed from the firearm locking mount 1, for reasons such as improper light installation torque of the muzzle device 2 to the barrel thread.

The drawings have shown the firearm locking mount 1 as having a reduced diameter, allowing the spring 9 to be buttressed by a diametrical shoulder 27. It should be obvious that the spring buttressing could be accomplished with a groove and retaining ring, or through other methods of giving the spring something to buttress itself against.

The sealing alignment tapers 19 and 20 have an included angle between 12 and 30 degrees. The adjustment of the taper angle provides a secondary means of adjusting mounting and prevailing torque characteristics, as well as fineness of the spline locking engagement for the system.

While one locking slot 12 is all that is required for the system to function, the provision of a plurality of locking slots 12, permits the additional slot 12 to be cut ½ of the number of axial degrees between grooves 15 on the muzzle mating device 2 is out of phase with the other. This effectively doubles the number of effective locking grooves 15, without needlessly reducing the strength and durability of the splines 16 and grooves 15 by making the features exceedingly fine.

In one embodiment, one locking slot 12 is three degrees out of the six degree per tooth of the sixty teeth defining 360-degree grooves 15 along an annular surface of the mount mating device 2. This allows one locking position to reduce the locking range by three degrees. Rather than two slots at six degrees which would be redundant, the second slot 12 effectively doubles the number of locking positions, by allowing one lock to be acquired at the axial spacing of half of the distance between splines 16 and grooves/teeth 16. This offset pair of locking position slots 12 facilitates the sliding engagement of the splines 16 and a pair of grooves 15 in an environment where there is a "stacking" or "stack up" of tolerances or accumulated variation in mechanical parts and assemblies. The tolerance stack ups or tolerance stacks in the present invention may include a tolerance in the spacing of the groves on top of a tolerance for the placement of the splines 16, plus a tolerance in the location of the locking slots 12, plus a tolerance associated with the collar couple to the body, etc.). In a perfect world only one slot 12 would be needed as two adjacent grooves 15 would symmetrically receive a spline 16; however, with the stacking of tolerances built into the mounting system and the mounting system being used in rugged environments, the three-degree out of phase arrangement of the two locking slots 12 enables a projected tolerance zone is defined to predicted on the assembly disclosed herein and its associated tolerance stack-up.

The Figures show a double locking slot configuration, complete with one medial unlocking position 10, permitting the 60 grooves to function as if they were 120 much less durable, very fine grooves. This in conjunction with a selection of a durable stub acme thread of 0.100 helix, and a taper angle assisting the device theory, provides a device capable of approximately three-degree accuracy of locking, well inside the 6-10 degrees of available axial sliding motion in contact with the sealing alignment taper. The locking slots 12 could obviously be machined into the collar 3 instead of the mount socket 5, but this would simply be mechanical re-arrangement of the present invention.

Figure 3:
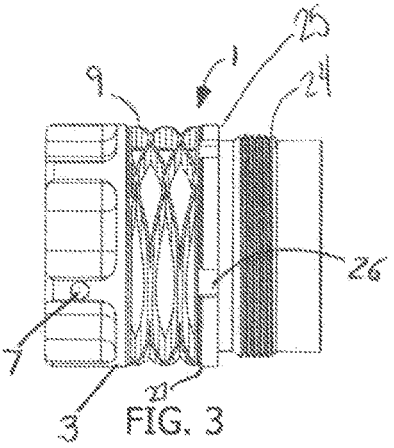
FIG. 3 is a side elevation view of an exemplary embodiment of a modular firearm locking mount 1, wherein the firearm locking mount 1 is configured for receiving silencers (e.g., through supplying tool receiving features and threading the firearm locking mount 1 with a common, public domain, silencer and muzzle accessory interface known as 1.375×24, or "HUB").
Figure 4:
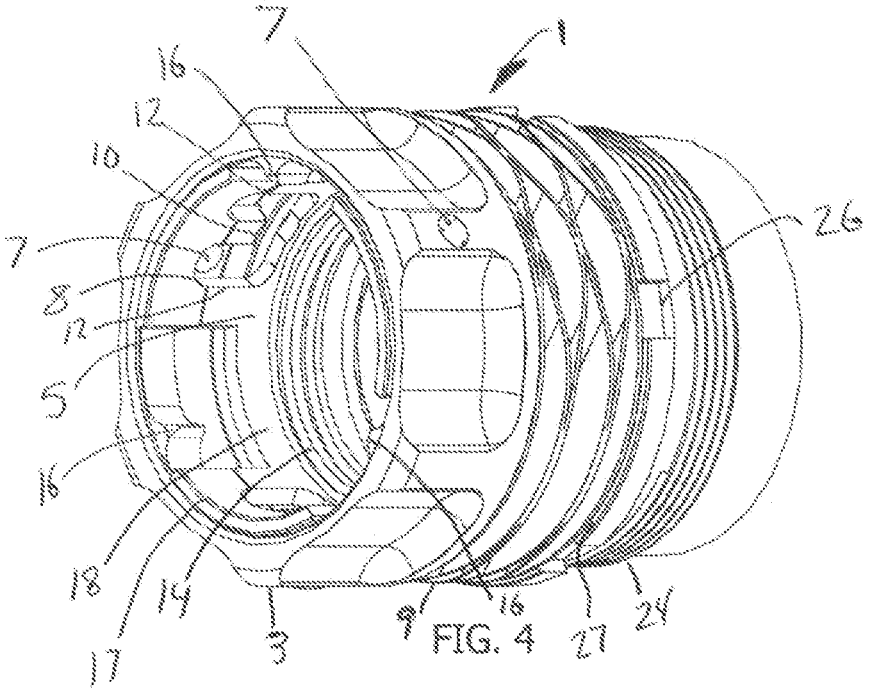
FIG. 4 is a perspective view of the modular firearm locking mount 1 of FIG. 3.
Figure 5:
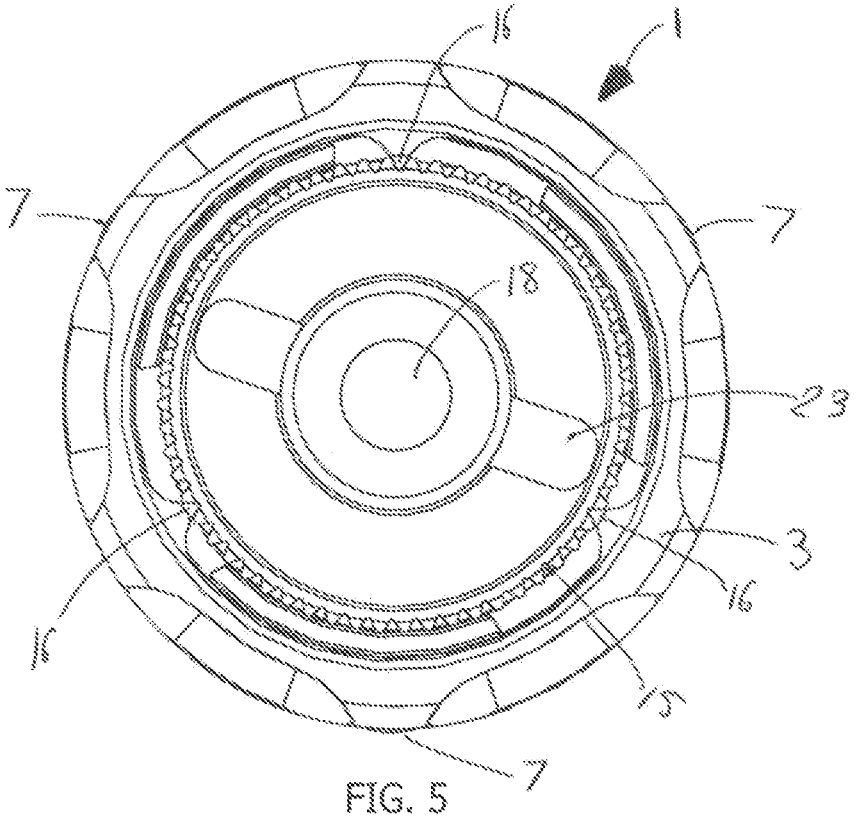
FIG. 5 is a rear elevation view of an exemplary embodiment of the firearm locking mount 1 in a locked configuration with the mated muzzle device 2 of FIGS. 1, 6, and 7 installed.
Figure 6:
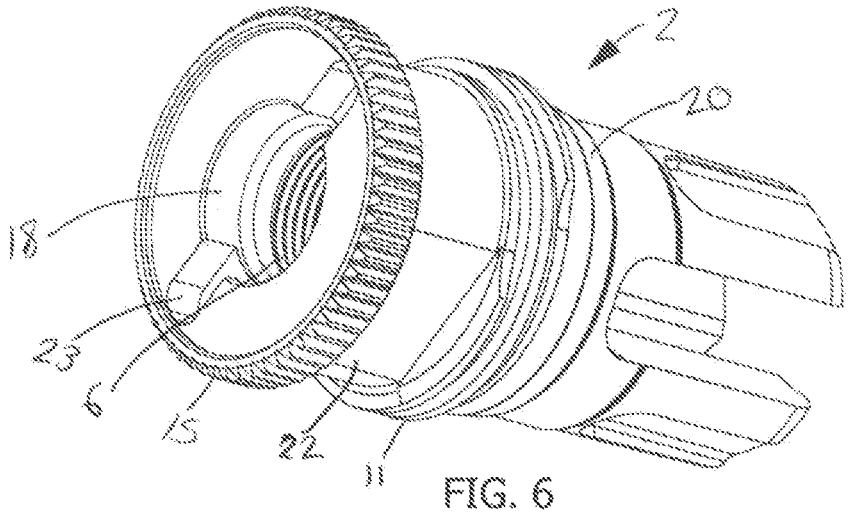
FIG. 6 is a rear perspective view of an exemplary embodiment of the muzzle mating device 2.
Figure 7:
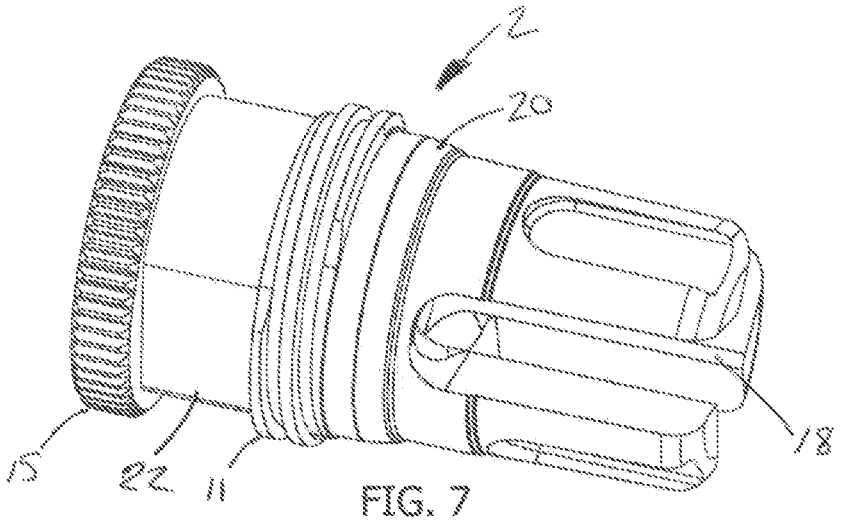
FIG. 7 is a front perspective view of an exemplary embodiment of the muzzle mating device 2.

FIG. 3 and FIG. 4 show the firearm locking mount 1 rather than natively manufactured into the suppressor, manufactured instead with 1.375×24 thread 24, and shoulder 25. They also show wrench receiving features 26. This is a public domain interface known as "HUB" or 1.375×24, and it demonstrates that the mount need not to be natively manufactured into a silencer, but rather can be a firearm muzzle accessory mount, capable of being threaded into a silencer, or threaded into a firearm muzzle accessory such as a blast shield, or blank firing adaptor. There are merits to both configurations—strength and thermal dissipation in the machined in, or welded in interface, and convenience of fitment, and ability to rapidly reconfigure the mount to another firearm muzzle accessory, in the HUB model. This 1.375 or HUB compatible version of the mount would not depart from the spirit and scope of the following claims.

The present invention includes a novel locking mount interface system for muzzle accessories of a firearm. The system embodies a muzzle mating device capable of rigidly mating with a locking mount (of a muzzle accessory) in one consistent axial orientation. The locking mount comprises a unique socket geometry for operatively associating with the muzzle mating device in a locked configuration or an unlocked configuration. The locking mount may either be natively manufactured into a muzzle accessory or a separate element removably attachable to a variety of muzzle accessories. The unique socket geometry permits a novel means of mounting a muzzle accessory to the muzzle of a firearm. The locking mounting interface system will provide fast, consistent attachment and locking security, with only minimal length and weight added.

The locking mount first attaches to the muzzle mating device by way of short coarse thread of 8 to 12 threads per inch helix disposed within the socket geometry. A conventional spring, or preferably, a sinusoidal wave spring loaded, locking collar, is coaxially located in a sliding engagement with the outer circumference of the socket. The locking collar is retained, and its motion is controlled, by one or more pins which confine the range of motion of the collar to a matching number of slots formed in the socket wall. Each slot comprises one or more locking positions and at least one unlocked position, allowing thread mating and threaded rotational assembly without interference or wear to the rotational locking mechanism—spline to groove contact. The muzzle mating device and thread socket of the locking mount possess compatible sealing alignment tapers in front of their corresponding attachment threads. Once fully thread and taper mated, the locking collar can be rotated from the unlocked position to one or more, locking positions.

If multiple locking positions are used, one of the locking slot positions may be one half of the muzzle device spline to spline angle out of relationship with the other locking slot locking position. Thus, multiple locking positions afford the capability to halve the degrees of angle the splines can arrest the assembly in. This halving of angle arrestment can afford the function of very fine, delicate splines, with the strength and durability of more coarse geometry. The internal diameter of the spring-loaded collar contains a plurality of splines, which are capable of sliding into grooves about the circumference of the muzzle mating device, to lock the muzzle mating device and the muzzle accessory operatively associated with the locking mount in a desired axial orientation.

A method of using the present invention may include the following.

1. Depress the locking collar and rotate and "hang" the collar in the depressed or "unlocked" position, removing the locking splines from potential contact with the grooves of the muzzle mating device.
2. Bayonet the locking mount onto the firearm-installed muzzle mating device, into thread contact therewith.
3. Rotate the locking mount approximately 1.5 revolutions, in a direction corresponding with the handedness of the threads, until firmly threaded into sealing alignment taper on taper engagement.
4. Depress the locking collar further and rotate the collar to a locking slot position.
5. Allow the spring to press the collar and search for sliding engagement between the locking splines of the collar and the grooves muzzle mating device (prior to reaching the rear-most locking position).
6. In multiple lock position versions, if no lock occurs, depress the collar, rotate to another locking position, and re-attempt step 5.
7. When the collar obtains sliding engagement between the splines and grooves, the mount collar spring will push the collar into full spline and groove contact, until the guiding pins reach the limits of the slots. The mount is now actively locked in its properly mounted, axial position.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A mounting system for a muzzle accessory of a firearm, the system comprising:

a muzzle mating device having a plurality of grooves radially spaced apart along an outer circumference thereof; and a locking mount comprising:

a socket for bayonetting the muzzle mating device;

a collar operatively associated with an outer circumference of locking mount in such a way as to be linearly movable between a locked position and an unlocked position;

one or more locking splines extending radially inward from a rearward portion of the collar to protrude into the socket, wherein the unlocked position the locking splines are linearly offset from the plurality of grooves in an unlocked configuration; and wherein the socket provides a structure that prevents rotation of the collar relative to the socket.

2. The mounting system of claim 1, wherein in the locked position each of the one or more splines slidably engages a groove of the plurality of grooves.

3. The mounting system of claim 1, further comprising:

a first thread along an outer circumference of the muzzle mating device; and a socket wall defining the socket, wherein a second thread is disposed along an inner circumference of the socket wall, wherein when said threads abut the collar is still movable between the locked position and the unlocked position.

4. The mounting system of claim 3, further comprising:

a locking pin extending radially inward from an inner surface of the collar; and one or more locking slots provided in the socket wall, wherein for each locking pin each locking slot provides a locked position point and provides an unlocked position point, wherein the locking pin is ridable along each locking slot between each locked position point and the unlocked position point.

5. The mounting system of claim 4, wherein the locked position point restrains rearward linear movement and rotational movement of the locking pin, and wherein the unlocked position point restrains rearward linear movement of the locking pin.

6. The mounting system of claim 5, wherein the locked position point is rearward of the unlocked position point.

7. The mounting system of claim 6, wherein the collar is biased in a rearward direction.

8. The mounting system of claim 7, further comprising a sinusoidal spring to bias the collar in the rearward direction.

9. The mounting system of claim 4, wherein the one or more locking slots are two locking slots set out of phase relative half of a groove axial phase of the plurality of grooves, wherein a half groove tolerance zone is enabled for the locked configuration.

10. The mounting system of claim 4, wherein the second thread is forward of the one or more locking slots.

11. The mounting system of claim 1, further comprising:

a socket wall defining the socket; and wherein the structure is a track or slot along the socket wall.

12. The mounting system of claim 11, further comprising:

wherein the track or slot prevents rotation more than ninety-degrees of the collar relative to the socket wall.

13. The mounting system of claim 1, wherein a distance between the locked and unlocked positions is greater than a linear length of each spline.

14. A mounting system for a muzzle accessory of a firearm, the system comprising:

a muzzle mating device having a first linear restraint and a first annular rotational restraint rearward of the first linear restraint; and a locking mount having a second linear restraint and a second rotational restraint, wherein the second rotational restraint is linearly movable relative to the second linear restraint between an unlocked position and a locked position operatively associating said rotational restraints, and wherein moving to the unlocked position linearly disassociates said rotational restraints, wherein the locking mount restricts the rotational movement of the second rotational restraint.

15. The mounting system of claim 14, wherein the linear movement is spring biased in the direction of the locked position.

16. The mounting system of claim 14, wherein the linear disassociation is in a direction normal to the plane of the first annular rotational restraint.

17. A mounting system for a muzzle accessory of a firearm, the mounting system comprising:

a first portion having a first rotational restraint; and a second portion having a collar with a second rotational restraint, wherein a linear movement of the collar relative to both the first and second portions operative associates of the first and second rotational restraints, wherein the second portion self restricts the rotational movement of the second rotational restraint to one radian or less, whereby relative rotational movement between the first and second portions is restrained.

18. The mounting system of claim 17, wherein the linear movement is spring-biased in the direction of the locked position.

19. The mounting system of claim 18, wherein the locked position comprises two locking slots set out of phase relative a first annular rotational restraint.

20. The mounting system of claim 17, wherein the first portion provides a first linear restraint, wherein the second portion provides a second linear restraint that are operatively associated prior to the operative association of said rotational restraints.

* * * * *